US011486120B2

(12) United States Patent
West

(10) Patent No.: US 11,486,120 B2
(45) Date of Patent: Nov. 1, 2022

(54) DRAIN GUARD DEVICE

(71) Applicant: Rennie West, Carson, CA (US)

(72) Inventor: Rennie West, Carson, CA (US)

( * ) Notice: Subject to any disclaimer, the term of this patent is extended or adjusted under 35 U.S.C. 154(b) by 48 days.

(21) Appl. No.: 16/881,227

(22) Filed: May 22, 2020

(65) Prior Publication Data

US 2020/0370287 A1 Nov. 26, 2020

Related U.S. Application Data

(60) Provisional application No. 62/851,141, filed on May 22, 2019.

(51) Int. Cl.
*E03C 1/264* (2006.01)

(52) U.S. Cl.
CPC ..... *E03C 1/264* (2013.01)

(58) Field of Classification Search
CPC . E03C 1/264; E03C 1/26; E03C 1/282; E03C 1/28; E03F 5/041
USPC ..... 4/286
See application file for complete search history.

(56) References Cited

U.S. PATENT DOCUMENTS 998,404 A * 7/1911 Schaffer ..... E03C 1/264 4/289
1,494,882 A 5/1924 Barger
1,950,817 A * 3/1934 Rossman ..... E03C 1/264 4/291
2,690,569 A * 10/1954 Kozerski ..... E03C 1/264 4/292
3,788,485 A * 1/1974 Bruning ..... E03C 1/264 210/474
4,471,497 A * 9/1984 Riutort ..... E03C 1/264 4/286
4,910,811 A 3/1990 Izzi
5,376,264 A 12/1994 Betancourt
6,687,925 B2 * 2/2004 Minnick ..... E03F 5/0407 4/286
7,832,027 B2 * 11/2010 Escobar ..... E03C 1/262 4/290
D754,470 S 4/2016 Rothfield et al.
2006/0273002 A1 * 12/2006 Maymudes ..... E03C 1/264 210/162
2009/0025128 A1 * 1/2009 Chong ..... E03C 1/264 4/292

(Continued)

FOREIGN PATENT DOCUMENTS

JP H08299711 A 11/1996

*Primary Examiner* — Benjamin R Shaw
(74) *Attorney, Agent, or Firm* — Argus Intellectual Enterprise; Jordan Sworen; Daniel Enea

(57) ABSTRACT

A drain guard device for preventing particulates from entering a drain. The drain guard device includes a ring member having an outer circumference and an inner circumference. A groove extends radially along the entire inner circumference. The groove is dimensioned to removably receive a strainer. The ring member is a flexible flat annular ring having a uniform width between the outer circumference and the inner circumference. In use, the drain guard rests over a drain, wherein the lower side of the ring member is configured to frictionally engage an upper side of a surface, such as a floor or sink. The lower side of the ring member is configured to form a suction seal with the upper side of the surface, wherein both the strainer and ring member can be easily removed from the surface by hand when desired.

19 Claims, 5 Drawing Sheets

(56) References Cited

U.S. PATENT DOCUMENTS

| | | | | |
|---|---|---|---|---|
| 2009/0049594 | A1* | 2/2009 | Landsberger | E03C 1/264 4/292 |
| 2010/0011494 | A1* | 1/2010 | Dees | E03C 1/264 4/292 |
| 2010/0059988 | A1 | 3/2010 | Matsumoto et al. | |
| 2010/0133167 | A1 | 6/2010 | Collins | |
| 2010/0213111 | A1* | 8/2010 | Won | E03C 1/264 210/163 |
| 2010/0213140 | A1* | 8/2010 | Won | E03C 1/264 210/163 |
| 2016/0040410 | A1* | 2/2016 | Carpenter-Crawford | B05B 1/06 4/652 |
| 2018/0231127 | A1* | 8/2018 | Kakehi | F16J 15/18 |
| 2019/0106869 | A1* | 4/2019 | Radi | E03C 1/186 |
| 2021/0164207 | A1* | 6/2021 | Cobb | E03C 1/264 |

* cited by examiner

DRAIN GUARD DEVICE

CROSS REFERENCE TO RELATED APPLICATION

This application claims the benefit of U.S. Provisional Application No. 62/851,141 filed on May 22, 2019. The above identified patent application is herein incorporated by reference in its entirety to provide continuity of disclosure.

BACKGROUND OF THE INVENTION

The present invention relates to a drain guard device. The present invention further provides a drain guard that is configured to fit over an open drain and filter particulates of a certain size from passing therethrough. Additionally, the present invention provides an attachment mechanism that does not require the need for conventional tools, such as a screwdriver, to mount to or remove from the drain.

Existing drain guards are commonly used to prevent objects, such as a ring, a bracelet, a pen part, or any other small article, from inadvertently falling down a drain of a sink or floor. These objects are hazardous and may clog or damage the drain if they enter it, sometimes requiring a professional to examine the pipes and extract the harmful object. Typically, the size of the object to be prevented from entering the drain is dictated by the size of filter apertures disposed on the drain guard. These drain guard are often secured to the floor or sink, above the drain, requiring tools to separate the drain guard from the drain.

Other drain guards include a strainer that rests within the drain for permitting liquid to flow through the holes of the strainer and enter the drain but preventing larger particles of material from flowing through the drain and thereby possibly clogging it. However, in order to remove the larger particles from the strainer within the drain, one must open the drainage well and access the pipes. This process is often time consuming and may result in the drain guard not being emptied in a timely manner. This can result in the sink getting clogged or smelling from the buildup of unwanted materials in the drain.

The present invention relates to a drain guard device and more particularly pertains to a new drain guard device that semi-permanently affixes to the area surrounding the drain via a friction seal that prevents water from passing through the seal.

The present invention provides a drain guard device that includes a ring member having an outer circumference and an inner circumference; a groove radially extending entirely along the inner circumference between an upper side of the ring member and an opposing lower side, wherein the groove is dimensioned to removably receive a strainer; a periphery of the strainer is configured to be seated within the groove and a filtration matrix configured to prevent particles of a predetermined size from passing therethrough; wherein the strainer extends entirely over an internal area circumscribed by the inner circumference and wherein the strainer is flat and extends entirely on a single horizontal plane; wherein the ring member is a flexible flat annular ring having a uniform width between the outer circumference and the inner circumference; wherein the drain guard is adapted to sit on top of a sink drain and the lower side of the ring member is configured to frictionally engage an upper side of the sink; wherein the lower side of the ring member is configured to form a suction seal with the upper side of the sink; wherein the strainer is configured to be selectively removable from the ring member.

The present invention provides a drain guard apparatus that optimizes accessibility and ease of use. This drain guard device is easily suctioned to and removed from the sink with no tools other than one's hands. Furthermore, the drain guard apparatus is easily disassembled for cleaning and extracting unwanted materials from the strainer.

In light of the devices disclosed in the known art, it is submitted that the present invention substantially diverges in design elements and methods from the known art and consequently it is clear that there is a need in the art for an improvement for drain guard devices. In this regard the instant invention substantially fulfills these needs.

SUMMARY OF THE INVENTION

In view of the foregoing disadvantages inherent in the known types of drain guard devices now present in the known art, the present invention provides a new drain guard device wherein the same can be utilized for preventing particulates and objects from entering a drain while allowing fluid to pass therethrough. Further, the present invention forms a waterproof seal between a lower side thereof and an upper side of a surface and drain perimeter.

In one embodiment of the invention, the drain guard includes a strainer that is removably affixed to a groove disposed on an inner circumference of a ring member. The strainer includes a filtration matrix that prevents objects of a certain dimension from entering the drain.

It is an objective of the present invention to provide in some embodiments, a taper extending from the outer circumference of the ring member towards the inner circumference of the ring.

It is also an objective of the present invention to provide a press-fit locking mechanism that semi-permanently couples the strainer seated within the groove to the ring member.

It is yet another objective of the present invention to provide a drain guard that prevents large particles from entering the piping system. The drain guard serves as a first filter to drains that may have a drain catch. The drain guard provides a device that is utilized with a sink or floor drain of reasonable size and can be quickly installed or moved to another drain. Additionally, in some embodiments, the drain guard device has interchangeable strainers that a user can selectively use to separate the particulate sizes desired.

It is therefore an object of the present invention to provide a new and improved drain guard device that has all of the advantages of the known art and none of the disadvantages.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
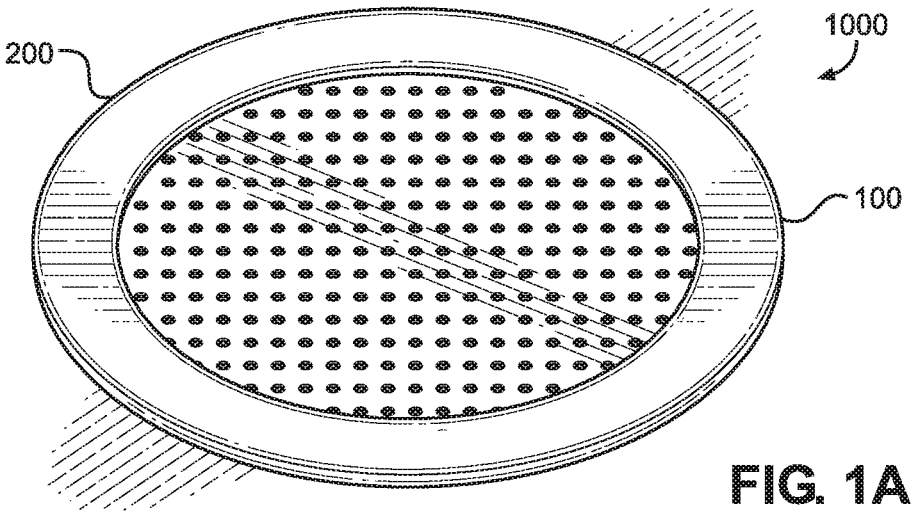
FIG. 1A shows a perspective view of a first embodiment of the drain guard device.

Reference is made herein to the attached drawings. Like reference numerals are used throughout the drawings to depict like or similar elements of drain guard device. For the purposes of presenting a brief and clear description of the present invention, the preferred embodiment will be discussed as used for preventing large particles from entering and clogging a drain. The figures are intended for representative purposes only and should not be considered to be limiting in any respect.

Reference will now be made in detail to the exemplary embodiment (s) of the invention. References to "one embodiment," "at least one embodiment," "an embodiment," "one example," "an example," "for example," and so on indicate that the embodiment(s) or example(s) may include a feature, structure, characteristic, property, element, or limitation but that not every embodiment or example necessarily includes that feature, structure, characteristic, property, element, or limitation. Further, repeated use of the phrase "in an embodiment", "first embodiment", "second embodiment", or "third embodiment" does not necessarily refer to the same embodiment.

Referring now to FIG. 1A, there is shown a perspective view of a first embodiment of the drain guard device. The drain guard device 1000 comprises a ring member 100 that is adapted to receive a strainer to collect larger particulates from blocking or otherwise clogging a drain. In the shown embodiment, the ring member 100 includes an outer circumference 200 and an inner circumference 300, whereby the strainer extends from the inner circumference thereof. In the illustrated embodiment, the ring member 100 is a flexible annular ring having a uniform width between the outer circumference 200 and the inner circumference 300. In the illustrated embodiment, the ring member 100 is substantially ground level in order to avoid being an obstacle or barrier for debris and liquid from flowing over the top surface of the ring member 100 and through a center thereof. In the illustrated embodiment, the vertical height of the ring member 100 is less than 2 mm. However, in alternate embodiments, the vertical height can vary depending if there is a type of debris a user wishes to prevent from passing over the inner circumference of the ring member.

A groove 500 extends radially along the entire inner circumference 300, wherein the groove 500 is dimensioned to removably receive the strainer. The ring member 100 comprises an opening 400 adapted to receive the strainer and allow liquid and small particulates to pass therethrough. In the illustrated embodiment, the inner circumference 300 is configured to be equal to or larger than a circumference of an opening of a drain opening on which the ring member 100 rests over while in use.

Figure 1B:
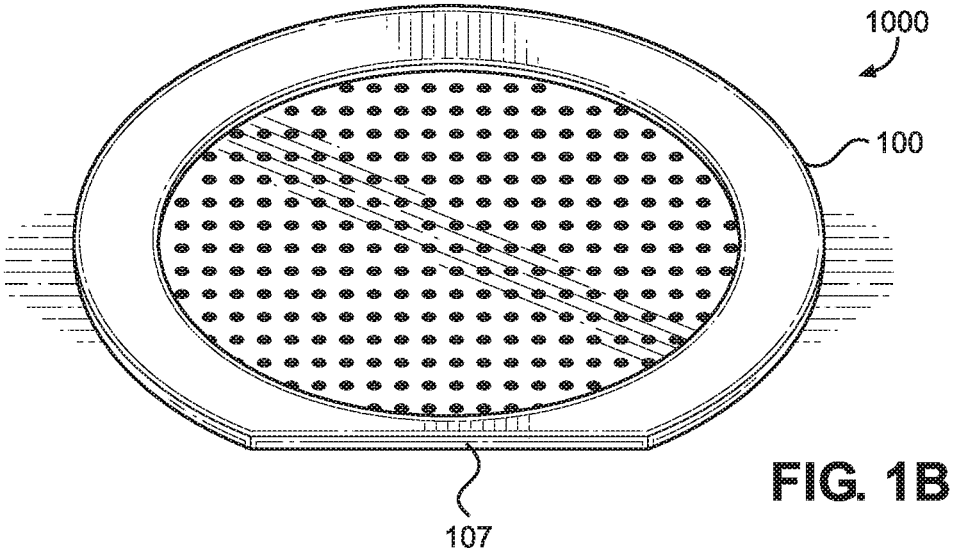
FIG. 1B shows a perspective view of an alternate embodiment of the drain guard device.

Referring now to FIG. 1B, there is shown a perspective view of an alternate embodiment of the drain guard device. In some embodiments, the drain guard device 1000 is designed to fit around a drain opening that abuts a wall, such as a bathtub drain or sink drain. The ring member 100 comprises a partial-circular shape defined as having a linear exterior edge 107. The linear edge 107 of the ring member 100 is adapted to fit around the drain opening without obstruction or contact from a wall extending from the surface of the drain opening. In the illustrated embodiment, the linear edge 107 extends entirely from opposing sides of the ring member 100. In some embodiments, the edge is concaved or non-linear in order to fit around irregular shaped objects abutting a drain opening.

Figure 2:
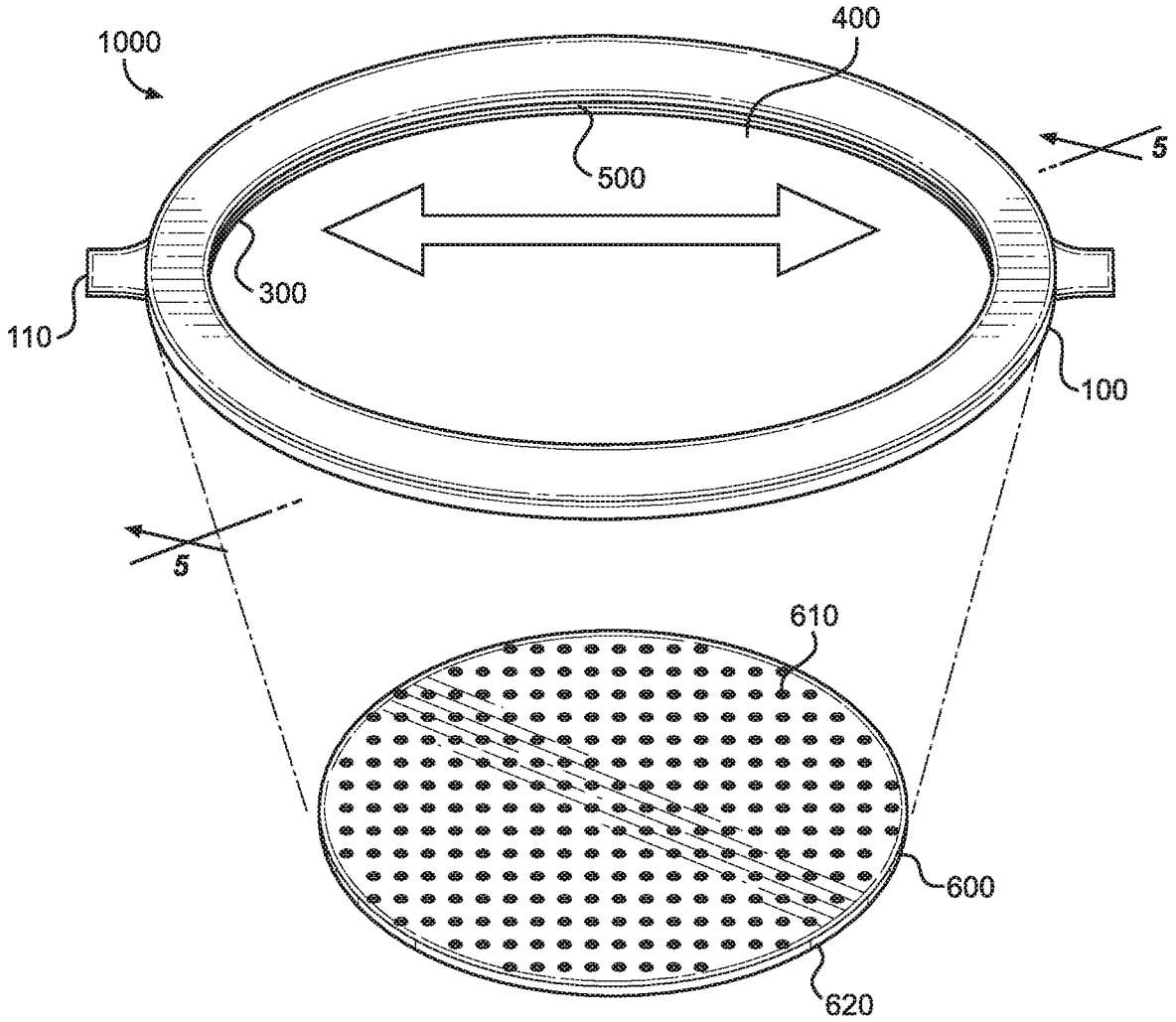
FIG. 2 shows a perspective view of a first embodiment of the drain guard device with the ring member and strainer separated.

Referring now to FIG. 2, there is shown a perspective view of a first embodiment of the drain guard device with the ring member and strainer separated. In the illustrated embodiment, the ring member 100 is elastic and composed of a material configured to allow the ring member to deform in order to stretch around the strainer. The ring member is composed of any suitable material such as rubber, rubber silicone, plastic, and the like. In some embodiments, the ring member 100 includes one or more tabs 110 thereon that provide a gripping area to manipulate the shape of the flexible ring member 100. In this way, the ring member 100 may be selectively manipulated to receive or release the removable strainer 600 from the ring member 100. In some embodiments, the tab 110 extends outward from the ring member 100 and is configured to lay flush against a surface, such as the floor, when the drain guard device 100 is secured thereto.

In some embodiments, the drain guard device 1000 comprises a strainer 600. The strainer 600 extends entirely over an internal area circumscribed by the inner circumference, wherein the strainer 600 is flat and extends entirely on a single horizontal plane. The strainer 600 includes a filtration matrix 610, such as mesh material or a series or interlocking members forming apertures throughout. The filtration matrix 610 is adapted to prevent the larger particulates from crossing from one side to the other side while allowing water and other fluids from passing across. An outer perimeter 620 of the strainer 600 is sized to fit within the groove 500 of the ring member 100.

Figure 3:
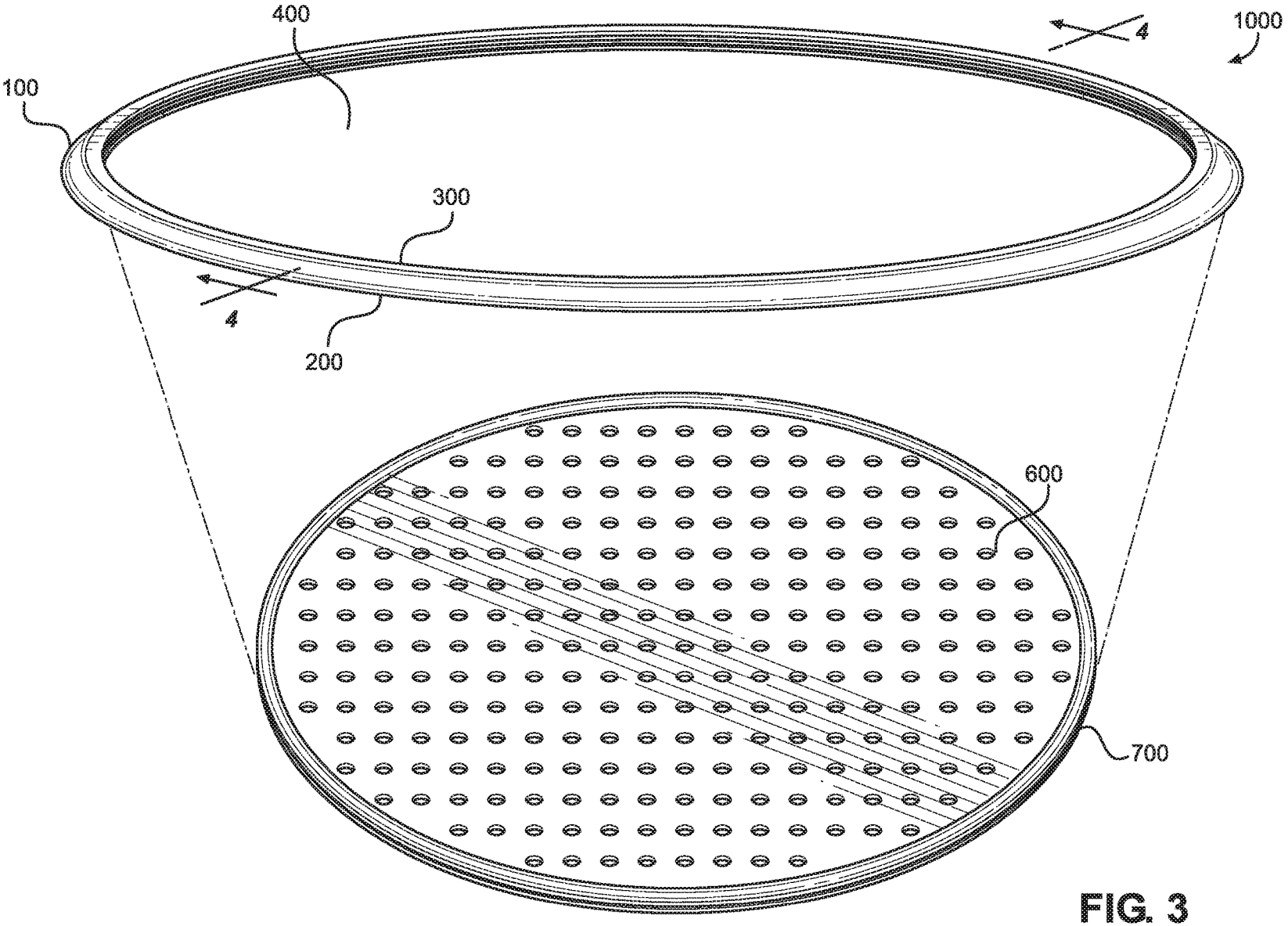
FIG. 3 shows a perspective view of a second embodiment of the drain guard device with the ring member and strainer separated.

Referring now to FIG. 3, there is shown a perspective view of a second embodiment of the drain guard device with the ring member and strainer separated. In the illustrated embodiment, the ring member 100 tapers from the outer circumference 200 to the inner circumference, such that the outer circumference is substantially surface level and the inner circumference is raised in order to prevent heavier debris and particulates from flowing over the ring member 100 and above the strainer 600. In this way, the strainer 600 receives less blockage from larger particulate to allow liquid to more freely flow therethrough. In some embodiments, the ring member 100 tapers from the outer circumference to a midpoint of the ring member, wherein the midpoint is positioned equidistant between the outer circumference and the inner circumference. In this way, the uppermost surface of the ring member 100 is flat.

In the illustrated embodiment, the drain guard device 1000 comprises an intermediary member 700 configured to secure to both the strainer 600 and the ring member 100. The intermediary member 700 comprises a flexible ring configured to friction fit around the outer perimeter of the strainer.

The intermediary member 700 is the portion of the strainer that is received within the groove when secured to the ring member 100 and which provides additional stability to the strainer. Thus, the strainer is configured to be selectively removable from the ring member. In the illustrated embodiment, a vertical height of the intermediary member 700 comprises a same vertical height of the groove 500. Therefore, the groove 500 is sized to receive the intermediary member 700 therein, such that in use the intermediary member entirely fills the groove 500 and the strainer 600 is coplanar with the opening 400 sharing an outer boundary therewith. In this way, the strainer 600 is floating above a drain opening. The intermediary member 700 is configured to secure to various strainers having different sizes while still allowing the strainer to be received by the ring member. In some embodiments, the intermediary member 700 is separable from the strainer. In alternate embodiments, the intermediary member forms an inseparable perimeter of the strainer.

Figure 4:
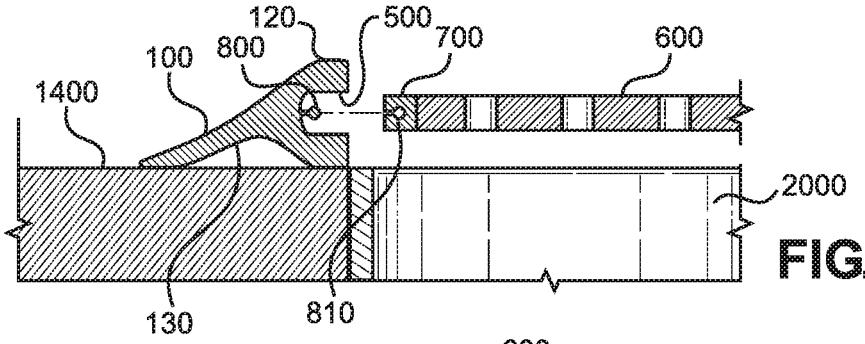
FIG. 4 shows a cross sectional view of a ring member of a second embodiment of the drain guard device taken along line 4-4 of FIG. 3.

Referring now to FIG. 4, there is shown a cross sectional view of a ring member of a second embodiment of the drain guard device taken along line 4-4 of FIG. 3. In the shown embodiment, the ring member 100 tapers from the outer circumference to the inner circumference. The groove 500 radially extends entirely along the inner circumference between an upper side 120 of the ring member 100 and an opposing lower side 130. In the shown embodiment, the groove 500 is positioned halfway between the upper side 120 and the lower side 130 of the ring member 100. However, in alternative embodiments, the groove 500 may be positioned at any point therebetween. In the illustrated embodiment, the strainer 600 is secured within the groove 500 via a press-fit locking mechanism of the ring member 100. The press-fit locking mechanism comprises a male-female connector 800, 810 that semi-permanently couples together when pressed and cooperatively fix the strainer therebetween. In some embodiments, one of the connectors 810 is disposed on the intermediary member 700. In alternate embodiments, the one of the connectors 810 extends directly from the strainer 600. The mating connector 800 extends directly from the groove 500.

The drain guard device 1000 is adapted to sit on top of a drain surface 1900, around a drain opening 2000, wherein the lower side 130 of the ring member 100 is configured to frictionally engage an upper side of the sink or drain surface 1900. In one embodiment, the lower side 130 of the ring member 100 is configured to form a suction seal with the upper side of the drain surface 1900. In the shown embodiment, the lower side of the ring member includes a concave portion that fastens the drain guard to the upper surface of the sink via suction. The suction is created from the pressing of the ring member towards the upper surface of the sink to expel air from the interior volume defined by the concavity, causing the pressure difference to effectively seal the drain guard to the sink. In alternative embodiments, the drain guard is secured to the sink via friction of the ring member material, via magnetic force, and the like. In one embodiment, the concave portion of the lower side 130 extends entirely around the ring member 100. In other embodiments, the concave portion of the lower side 130 are discrete portions spaced at intervals along the ring 100.

Figure 5:
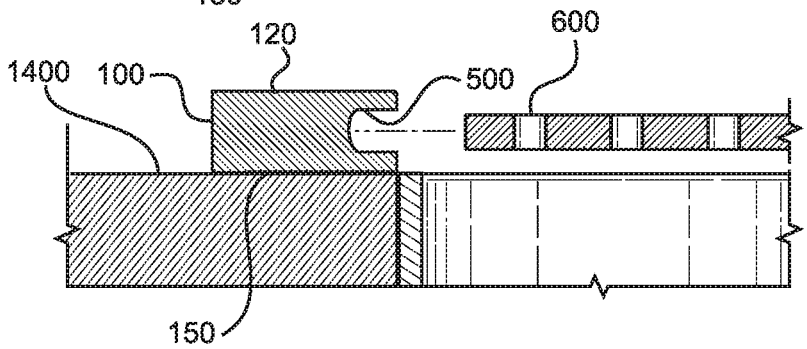
FIG. 5 shows a cross sectional view of a first embodiment of the drain guard device taken along line 5-5 of FIG. 1A.

Referring now to FIG. 5, there is shown a cross sectional view of a first embodiment of the drain guard device taken along line 5-5 of FIG. 1A. In the shown embodiment, the ring member 100 is comprises a uniform width from the outer circumference to the inner circumference. Further, the interior of the groove 500 includes a curved surface that is configured to engage with the strainer 600. In this way, the geometry of outward face and the flexibility of the ring member allows for a secure connection between the strainer and groove without requiring mechanical fasteners. In the illustrated embodiment, the ring member comprises a flat lower side 130 that is adapted to rest flush on a drain surface 1900. The lower surface of the ring member 100 comprises a non-slip surface to prevent the ring member 100 from moving when force is applied thereto when a user is sweeping or material is otherwise flowing over the upper 120 side of the ring member.

The ring member 100 is configured to sit atop the surface of the drain 1900 and provide a watertight seal between the upper surface of the sink and the lower surface of the ring member, thus forming a reservoir area about the drain guard. The reservoir area has a height equal to the height of the ring member and allows for very large objects and particles to settle before overflowing the upper side of the ring member to interact with the strainer. In this way, the formed reservoir area increases the effectiveness of the drain guard by settling the very large particulates before they partially obstruct the strainer and prevent the separation of large particles from the smaller particles and fluid.

Figure 6:
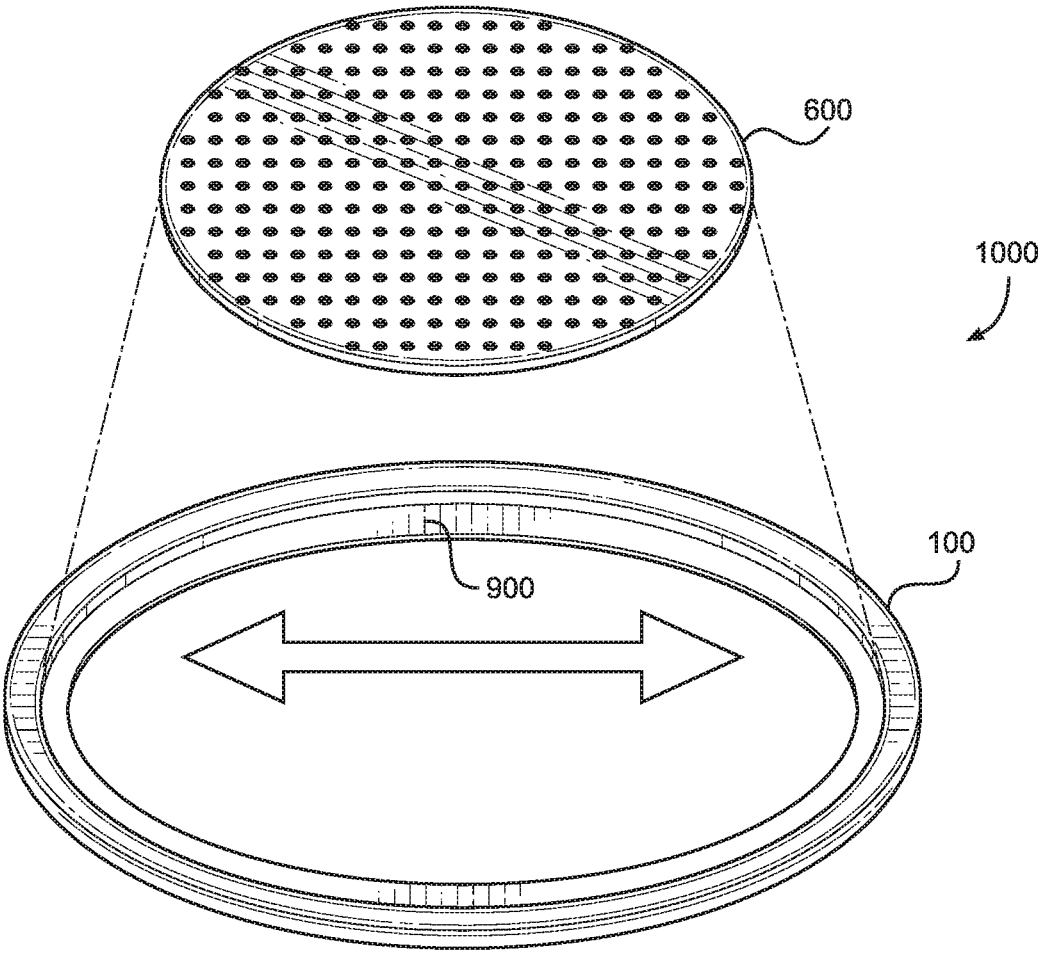
FIG. 6 shows a perspective view of a third embodiment of the drain guard device with the ring member and strainer separated.

Referring now to FIG. 6, there is shown a perspective view of a third embodiment of the drain guard device with the ring member and strainer separated. In the illustrated embodiment, the groove is replaced with or otherwise formed by a shoulder 900 that is disposed around the entire inner circumference of the ring member 100. The shoulder 900 is adapted to receive the strainer 600 thereon such that the upper surface of the strainer is level with the upper surface of the ring member 100. In this way, the strainer 600 is easily disposed within and removed from the ring member 100 without having to lift the ring member from a sink or drain surface.

Figure 7:
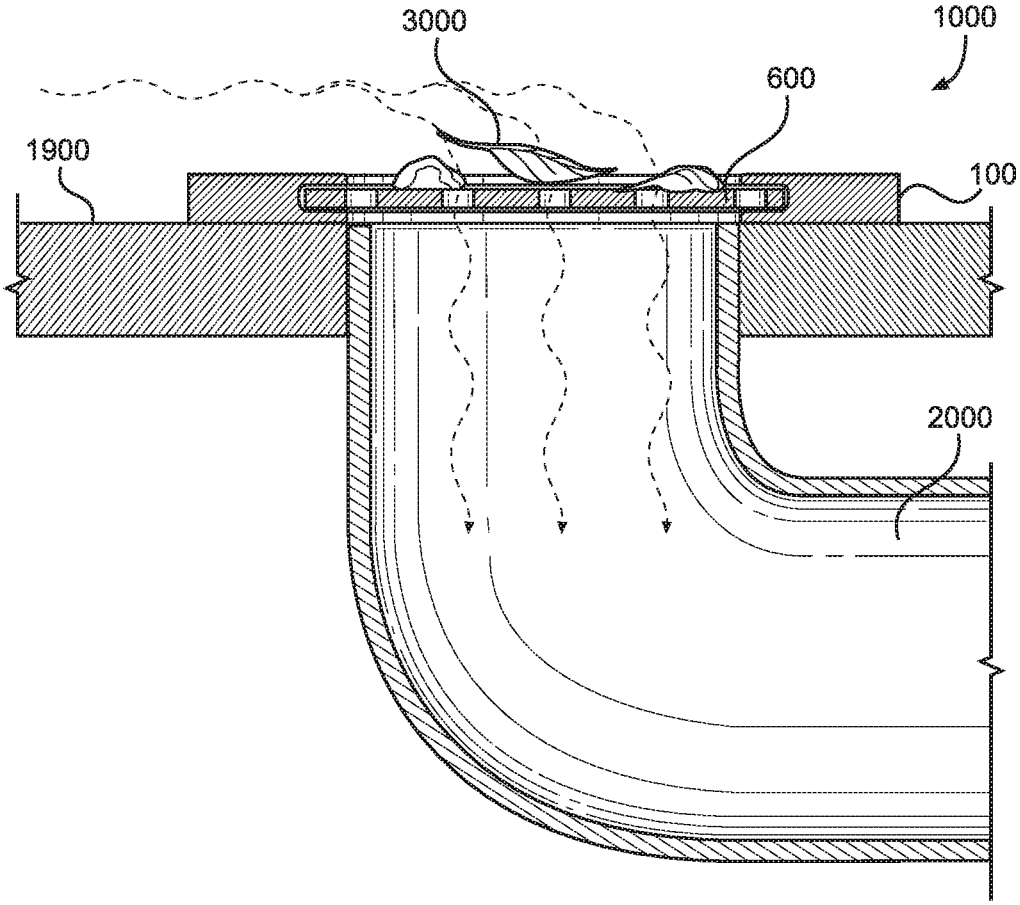
FIG. 7 shows a perspective view of an embodiment of the drain guard device in use.

Referring now to FIG. 7, there is shown a perspective view of an embodiment of the drain guard device in use. In operation, the drain guard device 1000 can easily be placed over a drain opening 2000 and removed without the need for tools to otherwise secure the drain guard device 1000 to the drain or surrounding surface 1900. The ring member 100 sits atop the drain opening 2000 and forms a waterproof seal with the surface surrounding the drain 1900. As fluid encounters the drain guard device 1000, the ring member 100 prevents fluid from entering the drainage until the height of the water surrounding the ring member exceeds the thickness of the ring member 100. Then, the strainer 500 prevents larger sized particulates 3000 from entering the drainage 2000. In some embodiments, the sloped structure is beneficial when sweeping or otherwise pushing liquid into the drain for removal thereof, along with smaller particulate such as dirt. The drain guard device 1000 can be easily removed from the drainage surface by hand. Further, the strainer 600 may be removed from the ring member 100 and interchanged with another strainer having substantially similar dimensions, although having a different filtration matrix. In one embodiment, the groove extends past the midpoint of the ring member, thereby allowing for strainers of various dimensions to be used with a single ring member.

In yet another embodiment, the strainer may include a rotating member that is adapted to rotate relative to the filtration matrix, such that the rotating member blocks or aligns with the aperture thereof causing the strainer to reconfigure between an open and closed configuration, respectively.

In some embodiments, the drain guard device consists of a ring member having an outer circumference and an inner circumference; a groove radially extending entirely along the inner circumference between an upper side of the ring member and an opposing lower side, wherein the groove is dimensioned to removably receive a strainer, the strainer adapted to capture particulates from passing therethrough; wherein the ring member is flexible; wherein the drain guard is adapted to sit over an open inlet of a drain and the lower side of the ring member is configured to frictionally engage an upper side of a surrounding drain surface; wherein the lower side of the ring member is configured to form a suction seal with the upper side of the surrounding drain surface; wherein the strainer is configured to be selectively removable from the ring member.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A drain guard device, comprising:

a ring member having an outer circumference and an inner circumference;

a groove radially extending entirely along the inner circumference between an upper side of the ring member and an opposing lower side, wherein the groove is dimensioned to removably receive a strainer, the strainer adapted to capture particulates from passing therethrough;

wherein the ring member is elastic and composed of a material configured to allow the ring member to deform in order to stretch around the strainer;

wherein the drain guard is adapted to sit over an open inlet of a drain and the lower side of the ring member is configured to frictionally engage an upper side of a surrounding drain surface;

wherein the lower side of the ring member comprises a concave portion configured to form a suction seal with the upper side of the surrounding drain surface by pressing the ring member towards the upper side of the surrounding drain surface to expel air from an interior volume defined by the concave portion, causing a pressure difference caused by the pressing and releasing to effectively seal the drain guard to the upper side of the drain surface;

wherein the strainer is configured to be selectively removable from the ring member.

2. The drain guard device of claim 1, wherein the ring member is annular having a uniform width between the outer circumference and the inner circumference.

3. The drain guard device of claim 2, further comprising the strainer wherein a periphery thereof is configured to be seated within the groove and a filtration matrix configured to prevent particles of a predetermined size from passing therethrough.

4. The drain guard device of claim 3, further comprising a gap between an interior face of the groove and the periphery of a first strainer when seated therein, such that the groove is configured to receive a second strainer comprising a larger circumference than the first strainer.

5. The drain guard device of claim 3, further comprising an intermediary member having a flexible ring disposed around a perimeter of the strainer and adapted to fit within the groove.

6. The drain guard device of claim 3, wherein the strainer extends entirely over an internal area circumscribed by the inner circumference and wherein the strainer is flat and extends entirely on a single horizontal plane.

7. The drain guard device of claim 2, wherein a thickness of the ring member tapers from the outer circumference to the inner circumference, wherein the thickness is measured between a lower side and an upper side of the ring member.

8. The drain guard device of claim 2, wherein an interior face of the groove includes a curved surface, between an upper side and lower side thereof, configured to engage with the strainer such that the strainer is configured to frictionally fit therein.

9. The drain guard device of claim 2, wherein the drain guard device is adapted to be semi-permanently mounted over a drain opening and removed entirely by hand and without the need for use of a tool.

10. The drain guard device of claim 2, wherein the drain guard device is symmetrical about a vertical plane and a horizontal plane, wherein the vertical plane and the horizontal plane each extend through a center point.

11. The drain guard device of claim 2, further comprising a press-fit locking mechanism having a male-female connector that semi-permanently couples together when pressed, wherein the male connector extends from a perimeter of the strainer and the female connector is disposed within the groove such that the strainer is adapted to secure to the ring via the press-fit locking mechanism.

12. The drain guard device of claim 2, further comprising a tab extending from the outer circumference of the ring member and configured to lay flush against the surrounding drain surface.

13. The drain guard device of claim 12, wherein the tab comprises a pair of tabs extending outward from opposing sides of the outer circumference of the ring member, such that the drain guard device is symmetrical about a vertical plane and a horizontal plane, wherein the vertical plane and the horizontal plane each extend through a center point.

14. The drain guard device of claim 2, wherein the ring member is configured to stretch and deform when a force is applied thereto in order to increase the circumference size of the groove and thereby receive the strainer within the groove, wherein the ring member is biased to an original shape when force is no longer applied, such that the circumference size of the groove decreases in order to retain the strainer therein.

15. The drain guard device of claim 2, wherein the groove extends uniformly and entirely along the inner circumference of the ring member.

16. The drain guard device of claim 2, wherein the groove comprises an open upper end and forms a shoulder configured to receive the strainer thereon.

17. The drain guard device of claim 1, wherein the ring member comprises a partial-circular shape defined as having a linear exterior edge.

18. The drain guard device of claim 17, wherein the linear exterior edge forms an outermost side of the ring member, such that the linear exterior edge is adapted to abut a wall.

19. The drain guard device of claim 1, further comprising the strainer wherein a periphery thereof is configured to be seated within the groove, the strainer including a filtration matrix configured to prevent particles of a predetermined size from passing therethrough, wherein an intermediary member having a flexible ring is disposed around a perimeter of the strainer and adapted to fit within the groove, wherein the intermediary ring is removably seated within the groove and entirely fills the groove such that the strainer is coplanar with the opening sharing an outer boundary therewith.

* * * * *